US005396262A

United States Patent [19]

Hastings, III

[11] Patent Number: 5,396,262

[45] Date of Patent: Mar. 7, 1995

[54] POLYSILICON GATE BUS WITH INTERSPERSED BUFFERS FOR DRIVING A ROW OF PIXELS IN AN ACTIVE MATRIX LIQUID CRYSTAL DISPLAY

[75] Inventor: William A. Hastings, III, Novato, Calif.

[73] Assignee: WAH-III Technology Corporation, Novato, Calif.

[21] Appl. No.: 170,394

[22] Filed: Dec. 20, 1993

Related U.S. Application Data

[62] Division of Ser. No. 22,665, Mar. 1, 1993.

[51] Int. Cl.[6] ..... G09G 3/36

[52] U.S. Cl. ..... 345/92; 345/87; 359/57; 359/59

[58] Field of Search ..... 345/87, 92, 98; 359/55, 359/57, 59

[56] References Cited

U.S. PATENT DOCUMENTS 3,862,360 1/1975 Dill et al. .
4,024,626 5/1977 Leupp et al. .
4,103,297 7/1978 McGreivy et al. .
4,191,452 3/1980 Grinberg et al. .
4,239,346 12/1980 Lloyd .
4,382,658 5/1983 Shields et al. .
4,432,610 2/1984 Kobayashi et al. .
4,602,850 7/1986 DeBenedetti .
4,839,707 6/1989 Shields .
5,165,075 11/1992 Hiroki et al. .
5,252,957 10/1993 Itakura .

FOREIGN PATENT DOCUMENTS 3257427 11/1991 Japan .

OTHER PUBLICATIONS

"Liquid Crystal TV Displays: Principles and Applications . . . ," by E. Kaneko, D. Reidel Publishing Company, KTK Scientific Publishers/Tokyo, Chapter 7.
"Capacitance Estimation," Chapter 4, pp. 131–134.
"Liquid Crystal MOS Matrix High Density Program," by Bleha et al., Final Technical Report, prepared for U.S. Army, Sep. 1, 1981, AD-A152987.

*Primary Examiner*—Alvin E. Oberley
*Assistant Examiner*—Matthew Luu
*Attorney, Agent, or Firm*—Majestic, Parsons, Siebert & Hsue

[57] ABSTRACT

A polysilicon gate bus structure used for activating a row of pixels in a matrix of pixels of an active matrix liquid crystal display is described. The polysilicon gate bus is formed with a plurality of buffers interspersed along its length. A plurality of field effect transistors, each associated with one pixel in a row of pixels, have their gate electrodes connected to the polysilicon gate bus with the buffers interspersed among the gate electrode connections so as to speed up a row scanning signal propagation time to each of the gate electrode connections.

5 Claims, 8 Drawing Sheets

POLYSILICON GATE BUS WITH INTERSPERSED BUFFERS FOR DRIVING A ROW OF PIXELS IN AN ACTIVE MATRIX LIQUID CRYSTAL DISPLAY

This is a division of application Ser. No. 08/022,665, filed Mar. 1, 1993.

BACKGROUND OF THE INVENTION

This invention relates in general to techniques for driving liquid crystal displays and in particular, to a technique, circuit, and bus structure for driving a row of pixels in an active matrix liquid crystal display.

U.S. Pat. No. 3,862,360 issued to Dill et. al., describes one construction of an active matrix liquid crystal display ("AMLCD"). The AMLCD is formed by confining a thin layer of liquid crystal material between two plates. One plate is typically a glass plate (also referred to herein as "front plate"), which has one large transparent electrode formed on a surface adjacent to the confined liquid crystal material. The other plate, is a processed silicon substrate (also referred to herein as "back plate"), which has a plurality of reflective electrodes formed on a surface adjacent to the confined liquid crystal material.

When an electric potential is applied across one of the back plate reflective electrodes and the front plate electrode (i.e., activating a "pixel"), the molecular alignment of the liquid crystal material between the two electrodes is altered. Depending upon the type of liquid crystal material being used, the liquid crystal material then acts as either a light valve or a light scattering medium to incident light entering through the front plate, passing through the liquid crystal material, and then being reflected back through the liquid crystal material and the front plate by the reflective electrode. For a general discussion on the structure and operation of such active matrix liquid crystal displays, see, e.g., Kaneko, E., *LIQUID CRYSTAL TV DISPLAYS*, KTK Scientific Publishers, Tokyo, 1987.

FIG. 1 illustrates an example of a portion of a conventional circuit used for activating selected pixels in a matrix array of pixels. Each pixel (e.g., 14) has a field effect transistor ("FET") and a storage capacitor associated with it which act together as an elemental sample and hold circuit for the pixel. For example, when a gate signal 5 is applied to a gate 16 of a FET 10, a display signal 3 being applied to a drain 18 of the FET 10 is "sampled" and charges a storage capacitor 12 which is connected to a source 15 of the FET 10. The storage capacitor 12 then "holds" the voltage provided by the display signal 3 for a pixel 14.

To drive a row of pixels in a matrix of pixels organized in rows and columns, a conventional technique is to provide pixel display signals along spaced apart, parallel column buses (e.g., 200, 210 and 220) which are properly timed with row scanning signals being sequentially provided to spaced apart, parallel row buses (e.g., 100 and 110). The storage capacitors associated with each row of pixels are then "refreshed" with the desired line image each time a row scanning signal is applied to the gates of the FETs associated with that row of pixels, and "hold" that line image for the row of pixels while other rows are being refreshed.

For example, when a row scanning signal 5 is provided to a row bus 100, each of the FETs (e.g., 10, 20 and 30) whose gate electrodes (16, 26 and 36, respectively) are connected to the row bus 100 pass display signals being provided to their drains (18, 28 and 38, respectively) along column buses (200, 210 and 220, respectively) to storage capacitors (12, 22 and 32, respectively) connected to the sources (15, 25 and 35, respectively) of the FETs (e.g., 10, 20 and 30). The storage capacitors (12, 22 and 32) then hold those voltages provided by the display signals while the next row of storage capacitors (e.g., 42, 52 and 62) is being charged by new display signals being provided over column buses (200, 210 and 220, respectively) while a row scanning signal is being applied to the next row bus 110.

FIG. 2A illustrates an example of a top plan view of part of a back plate for a conventional active matrix liquid crystal display of the type previously described, and FIGS. 2B and 2C illustrate cross-sectional cut-out views of that part of the back plate through lines 2B and 2C, respectively, of FIG. 2A. In particular, the figures illustrate a top plan view and cross-sectional views of two reflective electrodes, 240' and 340' along with certain circuit elements for driving the two electrodes. The figures are provided for illustrational purposes only, and are not intended to be drawn to scale nor laid out in any particular manner. Common reference numbers in the figures refer to the same elements being depicted.

Referring to FIGS. 2A–2C, the reflective electrodes, 240' and 340', and their respective drive circuitry are formed on the back plate of one type of active matrix liquid crystal display by first forming the drain (e.g., 21') and source (e.g., 23') regions of FETs in a top surface of a silicon substrate 70, and then forming a field oxide layer 71 over the top surface of the silicon substrate 70. Using conventional techniques, the field oxide layer 71 is then selectively etched away over channel areas (e.g., 24') of the FETs, and a thin oxide layer 72 is then formed over these channel areas (e.g., 24').

A polysilicon gate bus 100' (also referred to herein as a "row bus" or a "scanning electrode bus") is then formed along with polysilicon gate electrodes (e.g., 105') and polysilicon storage capacitor electrodes (e.g., 22') for each of the FETs. This is generally done by a conventional technique of depositing a layer of polysilicon material (also referred to as "polycrystalline silicon" material) over the field oxide layer 71 and the thin oxide layer 72, and then selectively removing portions of that layer so as to leave behind the polysilicon gate bus 100', gate electrodes (e.g., 105'), and storage capacitor electrodes (e.g., 22').

Another oxide layer 73 is then formed over the field oxide layer 71, polysilicon gate bus 100' gate electrodes (e.g., 105'), and storage capacitor electrodes (e.g., 22'). Using conventional techniques, holes (e.g., 25'') are then formed in the oxide layers 71 and 73 which extend from the top of the oxide layer 73 down to the drain regions (e.g., 21').

column buses (e.g., 210' and 220') (also referred to herein as "signal electrode buses") are then formed using conventional metallization techniques, along with contacts (e.g., 25') which connect the column buses (e.g., 210') to their proper FET drain regions (e.g., 21').

Another oxide layer 74 is then formed over the oxide layer 73, as well as over the column buses (e.g., 210' and 220'). Using conventional techniques, holes (e.g., 27'' and 242'') are then formed in the oxide layers 71, 73 and 74 which extend from the top surface of the oxide layer 74 down to the source regions of the FETs and polysilicon storage capacitor electrodes (e.g., 23' and 22', respectively).

Reflective electrodes (e.g., 240' and 340') are then formed using conventional metallization techniques, along with vias (e.g., 27' and 242') which connect the reflective electrodes (e.g., 240') to their respective source regions and storage capacitor electrodes (e.g., 23' and 22', respectively).

With the polysilicon storage capacitor electrodes (e.g., 22') thus connected to the source regions (e.g., 23') of their respective FETs through their respective reflective electrodes (e.g., 240'), the storage capacitors (e.g., 12 in FIG. 1) are then completed by grounding the substrate 70 which acts as a second electrode for each of the storage capacitors (e.g., 12 in FIG. 1), and using the field oxide layer 71 as a dielectric medium.

Although only a few representative pixels and their related drive circuitry have been shown in FIGS. 1, 2A, 2B and 2C, it is to be understood that active matrix liquid crystal displays may readily have thousands of such pixels organized in a matrix of rows and columns. When the number of such pixels is large in any given row of pixels, the resistive and capacitive load built up along the length of a polysilicon gate bus such as that illustrated as gate bus 100' in FIG. 2A–2C, can cause the last pixel in that row to switch ON and OFF much slower than the first pixel in that row. This transmission line effect optically results in an undesirable fading of contrast along the row of pixels which is further aggravated as the pixel size and pitch and consequently, the required width W of the polysilicon gate bus (e.g., 100') gets smaller.

To avoid the aforedescribed transmission line and resulting fading or non-uniform pixel contrast problem, the gate bus 100' might be formed of metal instead of polysilicon material. A metal gate bus, however, would require processing a third level of metallization which is very expensive using current processing technology. Not only would a third metallization layer require an additional oxide layer forming step, but it would also require additional photomasking and etching steps to form holes and contacts through the additional oxide layer down to previously deposited gate electrodes formed over the FET channel regions. Such an approach would result in significantly lower yields than the aforedescribed polysilicon gate bus approach.

OBJECTS AND SUMMARY OF THE INVENTION

Accordingly, one object of the present invention is to develop a technique and bus structure for driving a row of pixels in an active matrix liquid crystal display along a polysilicon gate bus without the aforedescribed transmission line and resulting non-uniform pixel contrast problems.

This and additional objects are accomplished by the various aspects of the present invention, wherein briefly stated, one aspect of the present invention is a circuit for driving a row of pixels in an active matrix liquid crystal display. Included in the circuit are a plurality of switching elements and a bus structure. Each of the switching elements has a control input and in response to that control input, controls the activation of one of the pixels in the row of pixels. Each of the control inputs is connected to the bus structure so that a row scanning signal transmitted through the bus structure can be concurrently provided to each of the control inputs in order that each of the pixels in the row of pixels can be activated concurrently.

The bus structure has a plurality of buffers interspersed among the connections of the control inputs of the plurality of switching elements to the bus structure. These buffers serve to reduce the RC time constants experienced by control inputs whose connections to the bus structure are further away from the source of the row scanning signal and accordingly, serve to enhance uniform contrast between the pixels being activated by the plurality of switching elements. In particular, these buffers are especially useful when the bus structure includes a thin strip of polysilicon as its conductive medium for providing the row scanning signal to each of the control inputs of the plurality of switching elements.

Another aspect of the present invention is a method of forming a bus structure for driving a row of pixels in an active matrix liquid crystal display, comprising the steps of: forming a plurality of switching elements including a first portion and a second portion of switching elements, and a plurality of buffers including a first buffer on a substrate, wherein each of the plurality of switching elements has a control input and each of the plurality of buffers has an input and an output; forming a first strip of polysilicon on the substrate, and connecting the control inputs of the first portion of switching elements and the input of the first buffer to the first strip of polysilicon; and forming a Second strip of polysilicon on the substrate, and connecting the control inputs of the second portion of switching elements and the output of the first buffer to the second strip of polysilicon; wherein the steps of forming the first and second strips of polysilicon are generally conducted concurrently.

Still another aspect of the present invention is a structure for driving four successive pixels in a row of pixels of an active matrix liquid crystal display. The structure includes four field effect transistors ("FETs") and a buffer formed on a silicon substrate, wherein each FET drives one of the four successive pixels. A first strip of polysilicon provides a row scanning signal to gate electrodes of the first and second FETs and an input to the buffer, and a second strip of polysilicon provides the output of the buffer to gate electrodes of the third and fourth FETs.

In a preferred embodiment of the invention, the first pixel of the four successive pixels is formed above and thus covers the first and second FETs, the second pixel is formed above and thus covers a portion of the buffer, the third pixel is formed above and thus covers the remaining portion of the buffer, and the fourth pixel is formed above and thus covers the third and fourth FETs. The buffer is preferably comprised of two inverters connected in series. Both inverters are preferably comprised of a p-channel and n-channel field effect transistor. The portion of the buffer covered by the second pixel is preferably the two n-channel field effect transistors and a small part of the two p-channel transistors, and the remaining portion of the buffer covered by the third pixel is preferably the remaining portions of the two p-channel field effect transistors.

Additional objects, features and advantages of the various aspects of the present invention will become apparent from the following description of its preferred embodiment, which description should be taken in conjunction with the accompanying drawings.

DESCRIPTION OF THE PREFERRED EMBODIMENT

Figure 6:
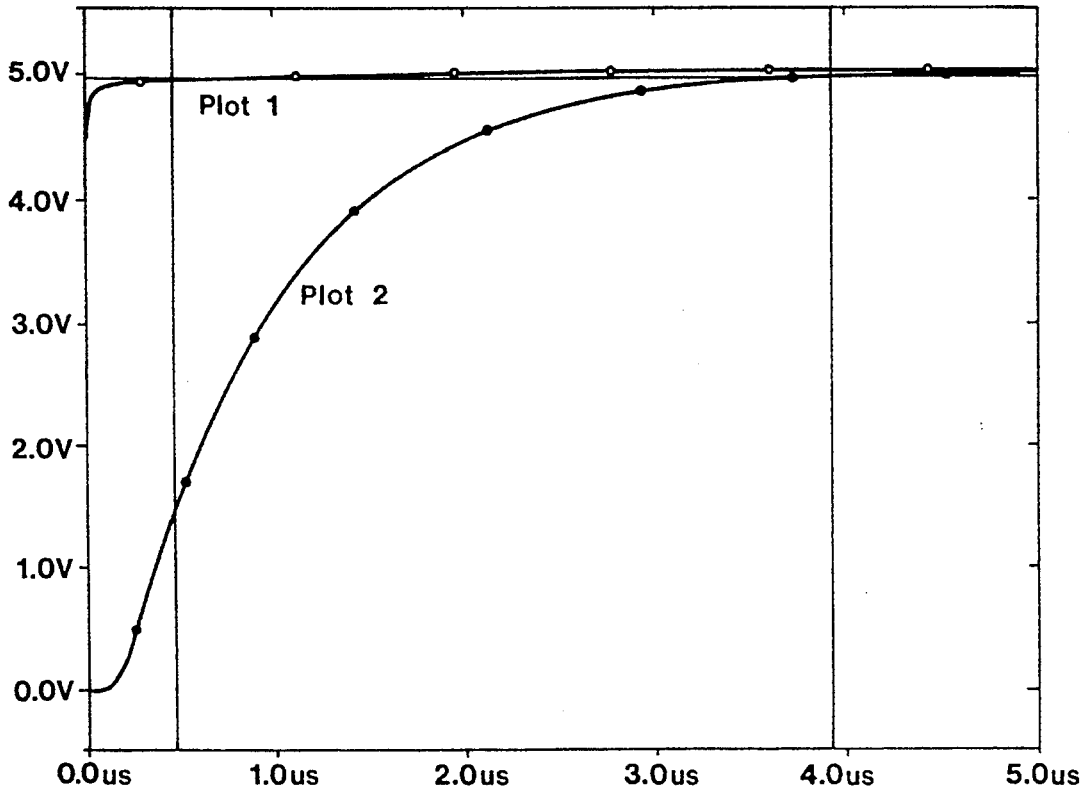
FIG. 6 shows simulated voltage responses at a 1st and 640th connection to a polysilicon gate bus.

Referring first to FIG. 6, two plots are shown. Both plots result from a computer simulation of a polysilicon gate bus having a width W of 3 microns ("μm") and a length sufficient to drive a row of 640 pixels at a 20 μm pixel pitch, wherein each of the 640 pixels has a field effect transistor ("FET") associated with it which serves to activate that pixel, and each of the FETs has a gate electrode connected to the polysilicon gate bus, a drain connected to a signal electrode bus, and a source connected to both a storage capacitor electrode and a reflective electrode of the type described in reference to FIGS. 2A–2C.

Plot 1 shows the voltage response at the gate electrode of a 1st FET which drives a 1st pixel in the row of 640 pixels, and plot 2 shows the voltage response at the gate electrode of a 640th FET which drives a 640th pixel in the row of 640 pixels. As can be seen from plot 2, it took approximately 3.94 microseconds ("μsec") for the voltage level at the 640th gate electrode connection to the polysilicon gate bus to charge up to 99% (location indicated by cursor) of a full charge level of 5.0 volts. Relative to the 640th gate electrode connection, the 1st gate electrode connection, as shown in plot 1, charged up almost instantaneously.

The problem with the voltage response as shown in plot 2 is that a 3.94 μsec response time far exceeds a maximum response time of 500 nanoseconds which is believed to be the slowest acceptable response time for providing flicker-free operation and reasonably uniform contrast between each of the pixels in the row of pixels. Since the voltage responses at the gate electrode connections in-between the 1st and 640th gate electrode connections are expected to respond proportionally between those calculated for the 1st and 640th, the voltage responses of many of these gate electrode connections are also expected to exceed the maximum response time of 500 nanoseconds.

Figure 3:
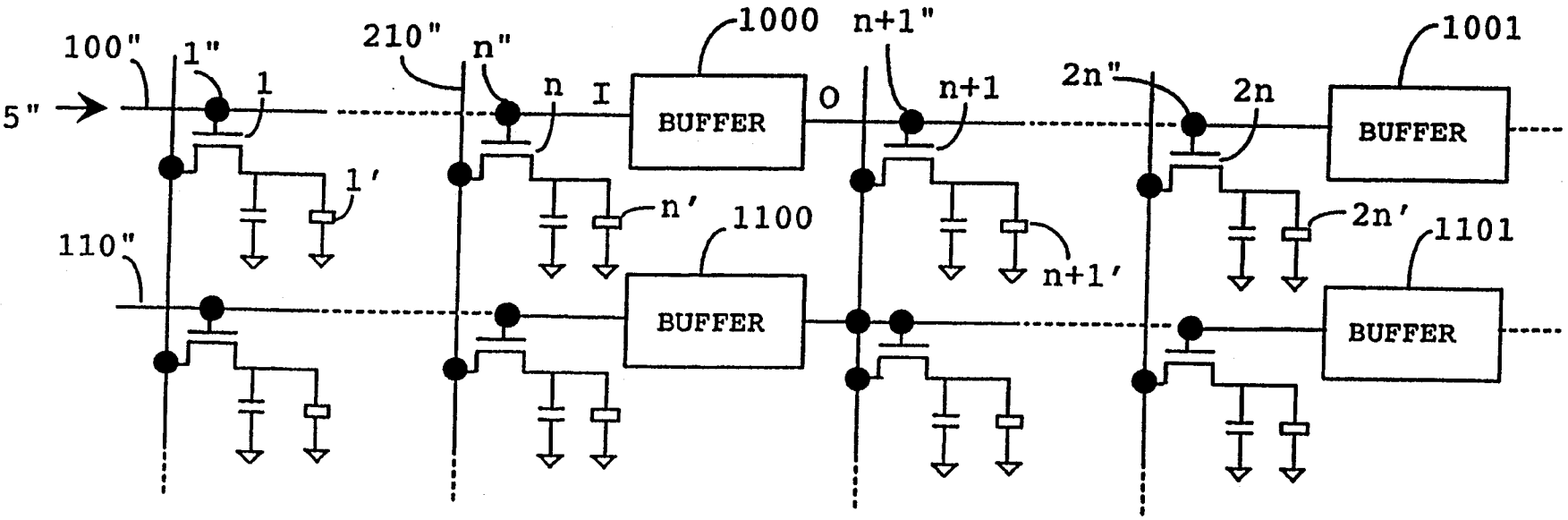
FIG. 3 illustrates an example of a portion of a circuit utilizing aspects of the present invention for activating selected pixels in a matrix array of pixels in an active matrix liquid crystal display.

FIG. 3 illustrates part of a circuit utilizing aspects of the present invention for activating selected pixels organized in a matrix array of rows and columns in an active matrix liquid crystal display ("AMLCD"). Along each polysilicon gate bus (e.g., 100'') associated with one row of pixels (e.g., the row with pixels 1' to n' n+1' to 2n' etc.) in the AMLCD, a plurality of buffers (e.g., 1000 and 1001) are interspersed between gate electrode contacts (e.g., 1'' to n'', n+1'' to 2n'', etc.) of the FETs (e.g., 1 to n, n+1 to 2n, etc., respectively) associated with each of the pixels (e.g., 1' to n', n+1' to 2n', etc., respectively) in the row of pixels.

Figure 4:
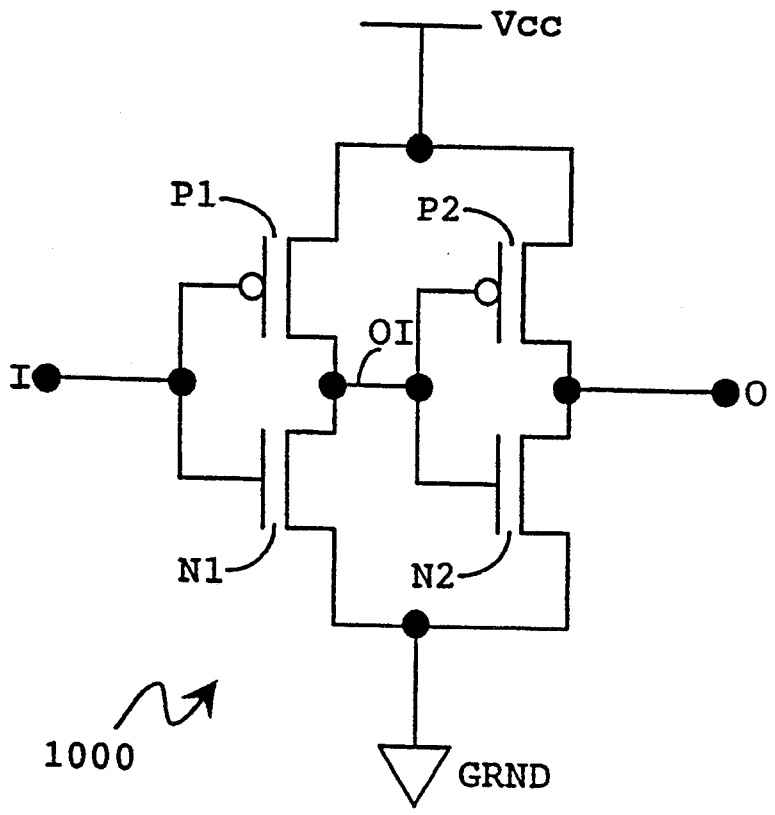
FIG. 4 illustrates a preferred embodiment of a buffer which is used in the circuit described in reference to FIG. 3, utilizing aspects of the present invention.

FIG. 4 illustrates a preferred embodiment of each of the buffers (e.g., 1000) as used in FIG. 3. The buffer 1000 has an input I and an output O, and comprises two inverters connected together in series. The first inverter comprises a p-channel FET P1 and an n-channel FET N1, and operates such that when the input I is a HIGH logic level, the p-channel FET P1 turns OFF and the n-channel FET N1 turns ON, thus pushing the output OI of the first inverter down to GRND, which acts as a LOW logic level. On the other hand, when the input I is a LOW logic level, the p-channel FET P1 turns on and the n-channel FET N1 turns OFF, thus pulling the output OI of the first inverter up to Vcc, which acts as a HIGH logic level. Thus, the output OI of the combination of p-channel FET P1 and n-channel FET N1 acts to invert the input I to the buffer 1000.

The second inverter comprises a p-channel FET P2 and an n-channel FET N2, and operates such that when the output OI of the first inverter is a LOW logic level, the p-channel FET P2 turns ON and the n-channel FET N2 turns OFF, thus pulling the output O of the buffer 1000 up to Vcc, which acts as a HIGH logic level, and when the output OI of the first inverter is a HIGH logic level, the p-channel FET P2 turns off and the n-channel FET N2 turns ON, thus pushing the output O of the buffer 1000 down to GRND, which acts as a LOW logic level. Thus, the output O of the buffer 1000 is LOW when its input I is LOW, and the output O of the buffer 1000 is HIGH when its input I is HIGH.

The buffers (e.g., 1000 and 1001) interspersed along the polysilicon gate bus (e.g., 100''), serve to regenerate the row scanning signal (e.g., 5'') after it has been "weakened" by the distributed resistive and capacitive loads along the length of the polysilicon gate bus (e.g., 100''). By interspersing buffers (e.g., 1000 and 1001) along the length of the polysilicon gate bus (e.g., 100''), the response times at the gate electrode connections to the polysilicon gate bus (e.g., 100'') speed up accordingly.

The propagation time $t_p$ of the row scanning signal 5'' as it travels along the polysilicon gate bus (e.g., 100'') can be calculated from the following well known equation: (See, e.g., Weste, Neil H. E., et. al., *Principles of CMOS VLSI Design,* Addison-Wesley Publishing Company, 1985, pp. 131–134).

$$t_p=(rcl^2)/2 \qquad (2)$$

where: r=resistance per unit length; c=capacitance per unit length; and l=length of the polysilicon gate bus.

By interspersing buffers along the length of the polysilicon gate bus (e.g., 100''), the propagation delay $t_p'$ to a 640th gate electrode connection to the bus can be calculated approximately by the following equation:

$$t_p' = (rc/2)*(l_1^2 + l_2^2 + l_3^2 + \ldots) + t_{buf1} + t_{buf2} + t_{buf3} + \ldots \quad (2)$$

where: r = resistance per unit length; c = capacitance per unit length; $l_1$ = length of the polysilicon gate bus from its start to the input of the first buffer (e.g., 1000); $l_2$ = length of the polysilicon gate bus from the output of the first buffer (e.g., 1000) to the input of the second buffer (e.g., 1001); $l_3$ = length of the polysilicon gate bus from the output of the second buffer to the input of the third buffer (not shown); $t_{buf1}$ = delay associated with the first buffer (e.g., 1000); $t_{buf2}$ = delay associated with the second buffer (e.g., 1001); and $t_{buf3}$ = delay associated with the third buffer (not shown).

Figure 7:
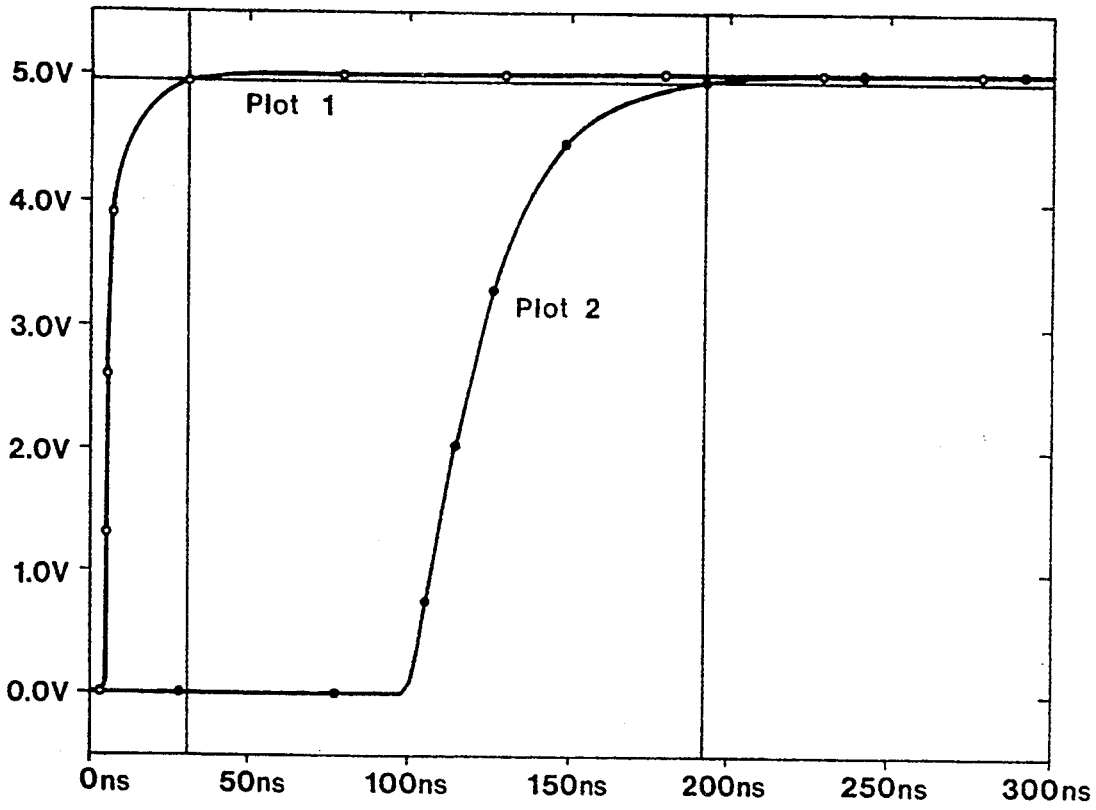
FIG. 7 shows simulated voltage responses at a 1st and 640th connection to a polysilicon gate bus having spaced apart buffers.

For example, FIG. 7 illustrates the results of a computer simulation using a polysilicon gate bus with interspersed buffers attached to the bus, and a row pixel structure similar to that as simulated in reference to FIG. 6. By placing a buffer after every 80th gate electrode connection to the polysilicon gate bus, plot 2 shows that the time required for the voltage at the 640th gate electrode connection to reach 99% of the full charge level of 5.0 volts is only 192 nanoseconds. This is significantly faster than the 3.94 μsec experienced without the buffers, and is well below the maximum response time of 500 nanoseconds which is believed to be required to provide flicker-free and uniform contrast operation across the row of pixels.

Although a pattern of equally spaced apart buffers after every 80th gate electrode connection to the polysilicon gate bus has been used in the above simulated example, other combinations are readily possible. For example, for thinner width W polysilicon gate buses, more buffer amplifiers might be required along the bus. Also, to minimize the number of required buffers, calculations or computer simulations might be conducted with various combinations of numbers of buffers and spacings of buffers between gate electrode combinations, with the 500 nanosecond maximum response time limitation for the last gate electrode connection to the polysilicon gate bus kept in mind.

Figure 1:
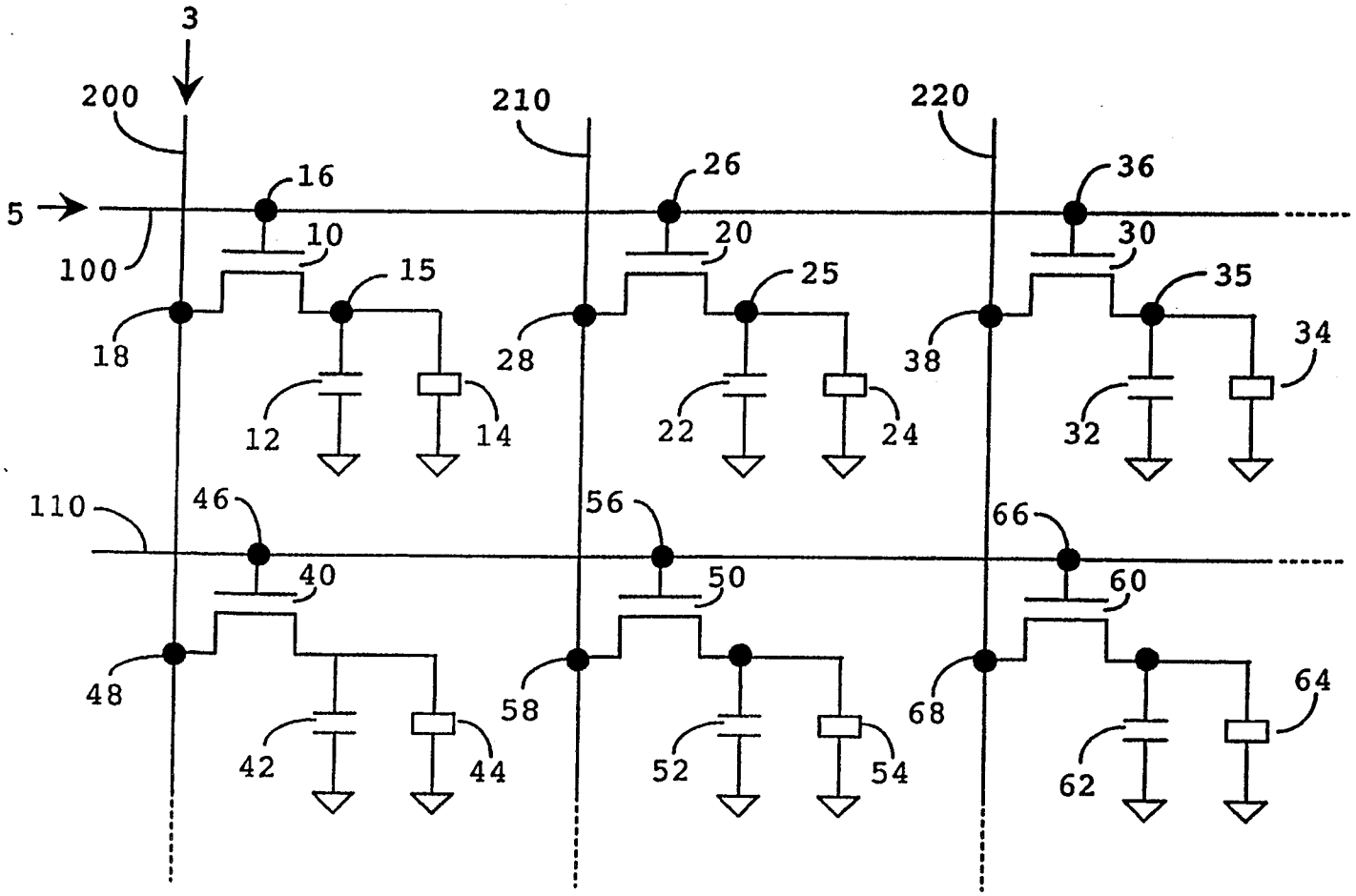
FIG.1 PRIOR ART
FIG. 1 illustrates a portion of a conventional circuit used for activating selected pixels in a matrix array of pixels in an active matrix liquid crystal display.
Figure 2A:
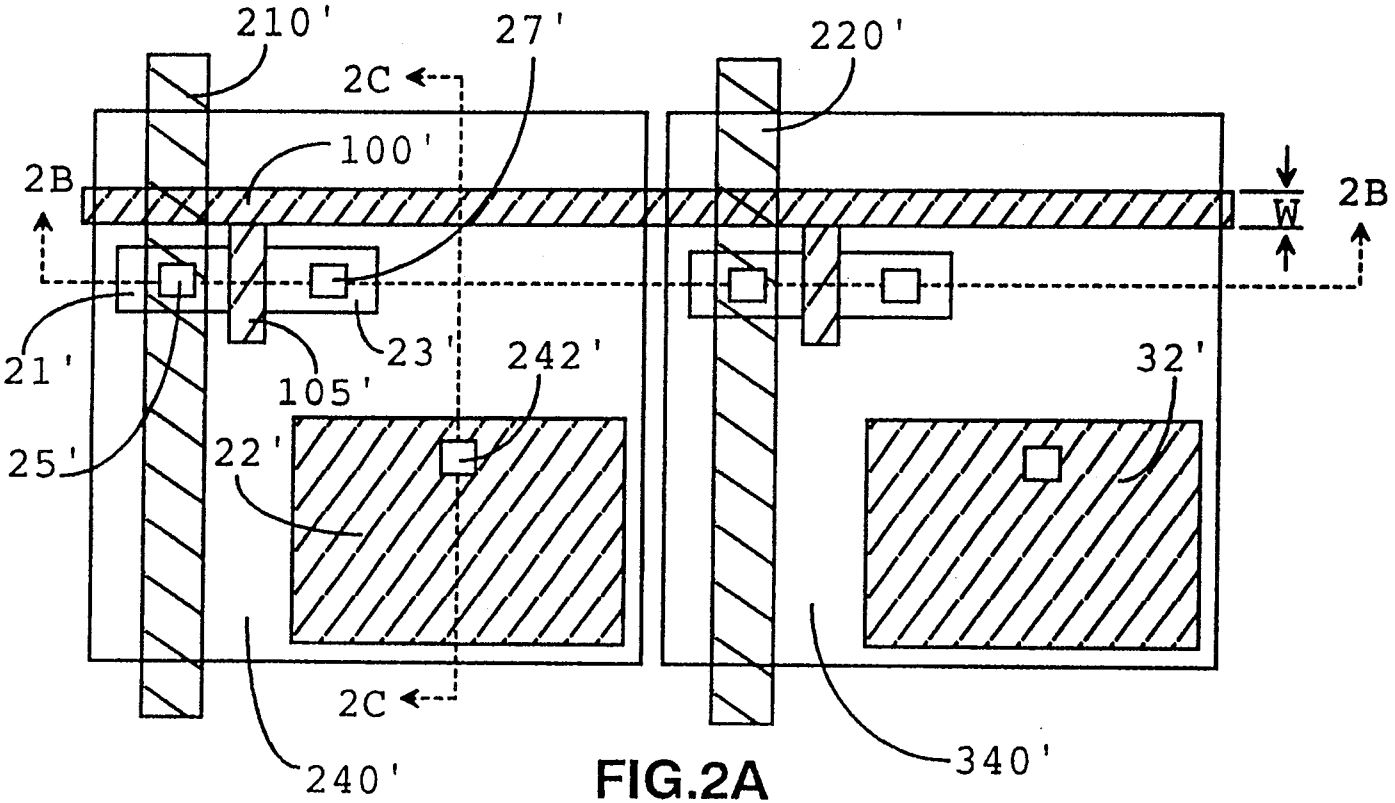
FIG.2A PRIOR ART
FIG. 2A illustrates an example of a top plan view of part of a back plate for a conventional active matrix liquid crystal display of the type described in reference to FIG. 1.
Figure 2B:
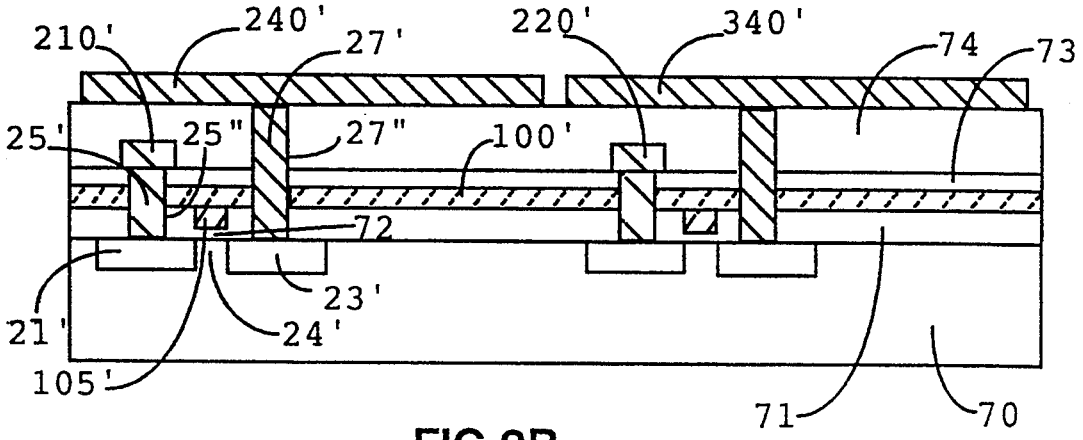
FIG.2B PRIOR ART
FIGS. 2B–2C illustrate cross-sectional views of that part of the back plate illustrated in FIG. 2A through dotted lines 2B and 2C in FIG. 2A.
Figure 2C:
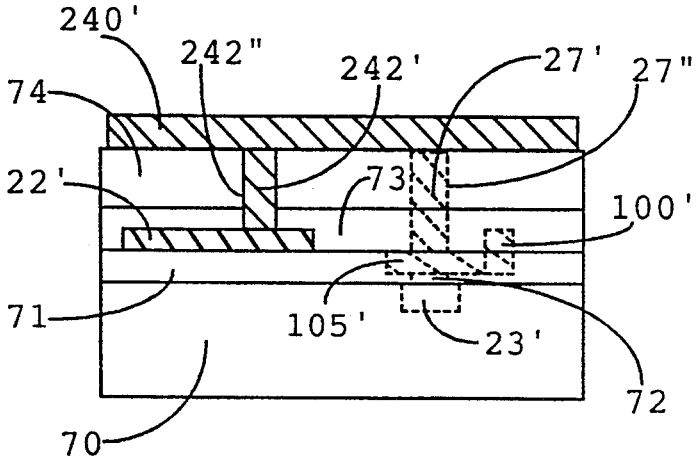
FIG.2C PRIOR ART
Figure 5:
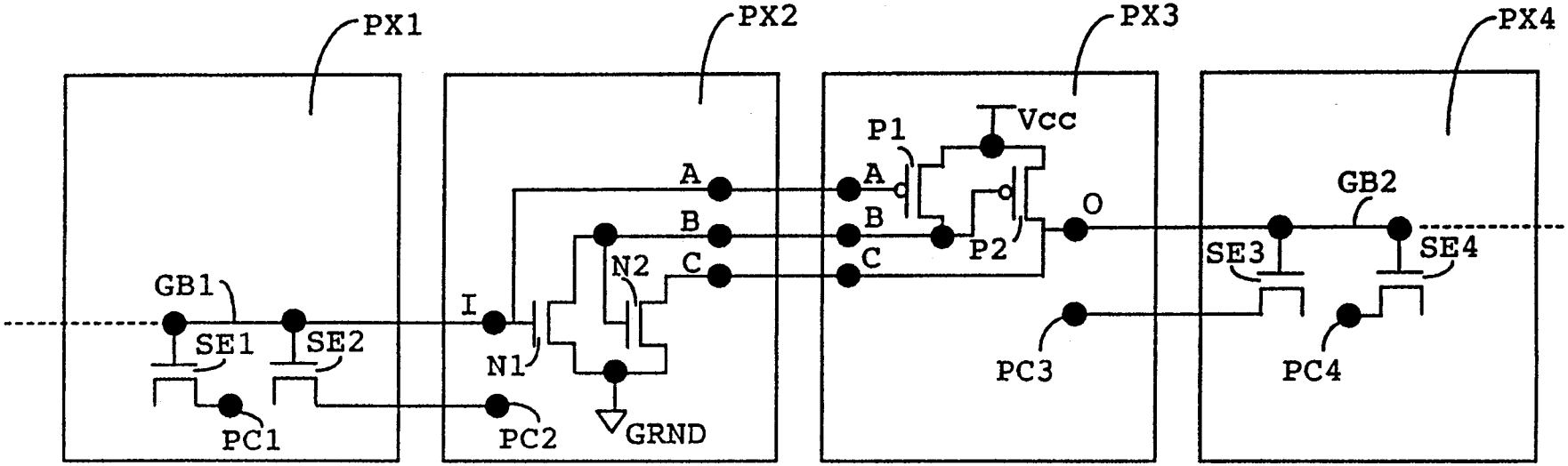
FIG. 5 schematically illustrates four successive pixels and parts of circuitry formed beneath each of the four successive pixels as part of a structure utilizing aspects of the present invention.

FIG. 5 schematically illustrates four successive pixels (wherein "pixel" is used synonymously with "reflective electrode" for the purposes of describing the present invention) and parts of circuitry formed beneath each of the four successive pixels as part of a structure utilizing aspects of the present invention. Formed under the first pixel PX1 of the four successive pixels, are two switching elements, SE1 and SE2, that activate pixels PX1 and PX2, respectively. Preferably, these two switching elements, SE1 and SE2, are n-channel FETs whose gates e.g. ("control inputs") are both connected to a polysilicon gate bus segment GB1 in a similar manner as depicted in FIG. 2A (i.e., using polysilicon gate electrodes such as 105'), and whose sources are connected to their respective pixels, PX1 and PX2, at connections PC1 and PC2, respectively. The polysilicon gate bus segment GB1 is connected at one end to the input I of a buffer.

Formed under the second pixel PX2 of the four successive pixels is a first portion of a buffer. Preferably, this first portion of the buffer comprises two n-channel FETs, N1 and N2, corresponding to the two n-channel FETs of the same designation in FIG. 4. To provide an electrical ground GRND to FETs N1 and N2, a ground bus runs parallel to the signal electrode buses connected to the drains of the pixel switching elements (e.g., SE1--SE4), and extends under the second pixel PX2.

Formed under the third pixel PX3 of the four successive pixels is a second portion of the buffer. Preferably, this second portion of the buffer comprises two p-channel FETs, P1 and P2, corresponding to the two p-channel FETs of the same designation in FIG. 4. In actual practice, however, design constraints may require a small portion of the two p-channel FETs, P1 and P2, to extend under the second pixel PX1. To provide a power source Vcc to FETs P1 and P2, a supply bus runs parallel to the signal electrode buses connected to the drains of the pixel switching elements (e.g., SE1–SE4), and extends under the third pixel PX3. By bifurcating the buffer in such a manner, either only a ground bus or a supply bus need extend under any one pixel, not both.

Finally, formed under the fourth pixel PX4 of the four successive pixels, are two switching elements, SE3 and SE4, that activate pixels PX3 and PX4, respectively. Preferably, these two switching elements, SE3 and SE4, are n-channel FETs whose gates are both connected to a polysilicon gate bus segment GB2, and whose sources are connected to their respective pixels, PX3 and PX4, at connections PC3 and PC4, respectively. The polysilicon gate bus segment GB2 is connected at one end to the output O of the buffer formed under pixels PX2 and PX3.

Although the various aspects of the present invention have been described with respect to a preferred embodiment, it will be understood that the invention is entitled to full protection within the full scope of the appended claims.

What is claimed is:

1. A method of forming a bus structure for driving, in response to a row scanning signal, a row of pixels in an active matrix liquid crystal display, comprising the steps of:

forming a plurality of switching elements including a first portion and a second portion of switching elements, and a plurality of means for regenerating said row scanning signal including a first means for regenerating said row scanning signal on a substrate, wherein each of said plurality of switching elements has a control input and each of said plurality of means for regenerating said row scanning signal has an input and an output;

forming a first polysilicon gate bus segment on said substrate, and connecting the control inputs of said first portion of switching elements and the input of said first means for regenerating said row scanning-signal to said first polysilicon gate bus segment; and forming a second polysilicon gate bus segment on said substrate, and connecting the control inputs of said second portion of switching elements and the output of said first means for regenerating said row scanning signal to said second polysilicon gate bus segment.

2. The method as recited in claim 1, wherein said step of forming said plurality of switching elements comprises the step of forming a first plurality of field effect transistors on a silicon substrate, wherein each of said first plurality of field effect transistors has a source region, a drain region, and a channel region.

3. The method as recited in claim 2, wherein said step of forming said plurality of means for regenerating said row scanning signal comprises the step of forming a plurality of groupings of field effect transistors on said silicon substrate, wherein said groupings are interspersed among said first plurality of field effect transistors, and each of said groupings functions as a means for regenerating said row scanning signal.

4. The method as recited in claim 1, further comprising before said forming steps, the step of predetermining a required number of said plurality of means for regenerating said row scanning signal by computer simulating said bus structure with varying numbers of means for regenerating said row scanning signal interspersed among said plurality of switching elements, and determining said required number when a simulated response time for a slowest responding pixel in said row of pixels is no greater than 500 nanoseconds.

5. A method of forming a bus structure for driving a row of pixels in an active matrix liquid crystal display, comprising the steps of:

forming a plurality of switching elements including a first portion and a second portion of switching elements, and a plurality of buffers including a first buffer on a substrate, wherein each of said plurality of switching elements has a control input and each of said plurality of buffers has an input and an output;

forming a first polysilicon gate bus segment on said substrate, and connecting the control inputs of said first portion of switching elements and the input of said first buffer to said first strip of polysilicon;

forming a second polysilicon gate bus segment on said substrate, and connecting the control inputs of said second portion of switching elements and the output of said first buffer to said second polysilicon gate bus segment;

forming a plurality of reflective electrodes including a first portion and a second portion of reflective electrodes;

wherein said first portion of switching elements includes a last switching element, and said first portion of reflective electrodes includes a last reflective electrode and a next to last reflective electrode;

wherein said second portion of switching elements includes a first switching element, and said second portion of reflective electrodes includes a first reflective electrode and a second reflective electrode;

wherein each one of said first portion of reflective electrodes is uniquely associated with one of said first portion of switching elements, and each one of said second portion of reflective electrodes is uniquely associated with one of said second portion of switching elements;

wherein each one of said first portion of reflective electrodes covers the switching element which is uniquely associated with said one reflective electrode, except said last reflective electrode which covers said first part of said buffer, and each one of said second portion of reflective electrodes covers the switching element which is uniquely associated with said one reflective electrode, except said first reflective electrode which covers said second part of said buffer; and wherein said next to last reflective electrode of said first portion of reflective electrodes covers the switching element which is uniquely associated with the last reflective electrode of said first portion, and said second reflective electrode of said second portion of reflective electrodes covers the switching element which is uniquely associated with the first reflective electrode of said second portion.

* * * * *